United States Patent [19]

Dotti

[11] 4,098,090

[45] Jul. 4, 1978

[54] RIGID, DEMOUNTABLE BUOY SUPPORT

[75] Inventor: Giuseppe Dotti, Milan, Italy

[73] Assignee: Snamprogetti S.p.A., Italy

[21] Appl. No.: 637,123

[22] Filed: Dec. 3, 1975

[30] Foreign Application Priority Data

Dec. 3, 1974 [IT] Italy ..... 30125 A/74

[51] Int. Cl.[2] ..... E02B 17/00

[52] U.S. Cl. ..... 61/102; 52/654; 52/719

[58] Field of Search ..... 61/46, 46.5, 86, 102; 52/637, 646, 648, 654, 655, 719; 182/179

[56] References Cited

U.S. PATENT DOCUMENTS

| | | | |
|---|---|---|---|
| 1,465,969 | 8/1923 | Claflin | 52/646 |
| 1,626,864 | 3/1927 | Neilson, Jr. | 52/646 X |
| 2,941,634 | 6/1960 | Hanks, Sr. et al. | 52/640 |
| 3,547,224 | 12/1970 | Watts | 182/179 |
| 3,724,222 | 4/1973 | Crain | 61/46 |

FOREIGN PATENT DOCUMENTS

| | | | |
|---|---|---|---|
| 676,588 | 6/1939 | German Democratic Rep. | 52/654 |

*Primary Examiner*—Jacob Shapiro
*Attorney, Agent, or Firm*—Morgan, Finnegan, Pine, Foley & Lee

[57] ABSTRACT

The invention relates to a locking device for converting an articulated system into a rigid one, more particularly for buoys having articulated legs; the locking device consists of a frame adapted to be mounted to the legs of the buoy and comprising a jaw locking system, in which the jaws consist of split sleeves.

5 Claims, 3 Drawing Figures

RIGID, DEMOUNTABLE BUOY SUPPORT

The present invention relates to a locking device permitting an articulated system, comprising universal and/or ball joints, to be converted into a rigid system. More particularly, the present invention permits an oscillating system consisting of a buoy provided with legs articulated by universal and/or ball joints to be converted into a rigid system, fixed to the sea bed; to this embodiment reference is made in the following disclosure for a better understanding of the invention, which must not be construed as being restricted thereto, since the extension to other like systems is readily inferred and easily understandable by those skilled in the art.

According to the current art, for the locking of buoys having articulated legs comprising universal and/or ball joints, use is made of external means, such as depot ships, or platforms or repair pontoons, which, by directly acting on the oscillating structure of the buoy, permit it to be made entirely rigid.

By this technique, these means are not leading to a ready and economical use, either for assembling and/or for dismounting operations, or for servicing or possibly urgent repair.

I have been found that it is possible to construct a device permitting the articulated structure to be made completely rigid, thus allowing the afore-mentioned operations to be carried out in a ready and economical manner.

Such a device consists of a special frame, which is stiffened by beams having various cross-sections and strength, and is easily removable after the use. This frame is attached to the legs of the buoy (according to their number), by means of a quick coupling system, e.g. jaws formed by split sleeves, and permits the oscillating articulated system to be converted into a rigid system, which is stationary with respect to the marine bed. Such a device allows the articulated legs of the buoy to be easily assembled and/or dismounted, as well as the joints or their parts, even during the normal servicing. The frame, moreover, is provided with datum devices permitting imarine bed. Such a device allows the articulated legs of the buoy to be easily assembled and/or dismounted, as well as the joints or their parts, even during the normal servicing. The frame, moreover, is provided with datum devices permitting it to be mounted to every type of basement and/or to the body of the buoy, the assembling and/or the dismounting of the several parts being permitted according to their right position and orientation.

More particularly, in the following disclosure reference is made to the device as being applied to a three legged buoy, the legs being articulated by means of universal and/or ball joints, this disclosure being, as already stated, explanatory but not limitative of the present invention.

BRIEF DESCRIPTION OF THE DRAWING

With reference to FIGS. 1, 2, 3, the device is illustrated as comprising a frame stiffened by beams 1, having several cross-sections and strength; this frame is attached to the legs of the buoy by means of the coupling system comprising split sleeves 2, with bolts 2 a and datum and locking struts 3; the latter, to permit a complete stiffening of the structure, are restrained by suitable locators 4, provided both on the body of the buoy and on the marine bed.

Figure 1:
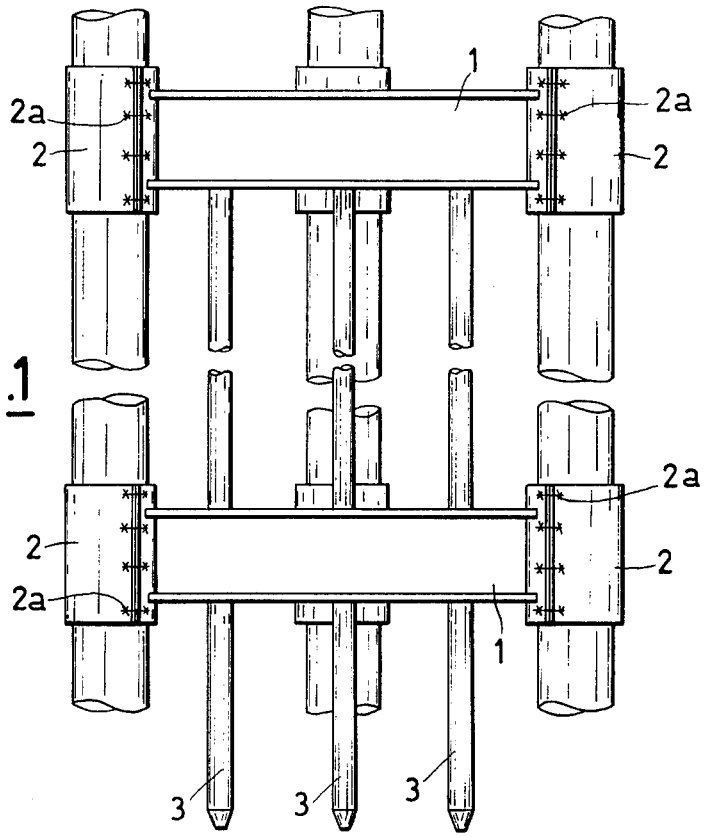
FIG. 1 is a fragmentary side elevation of a buoy support equipped with a pair of the locking devices of my invention.
Figure 2:
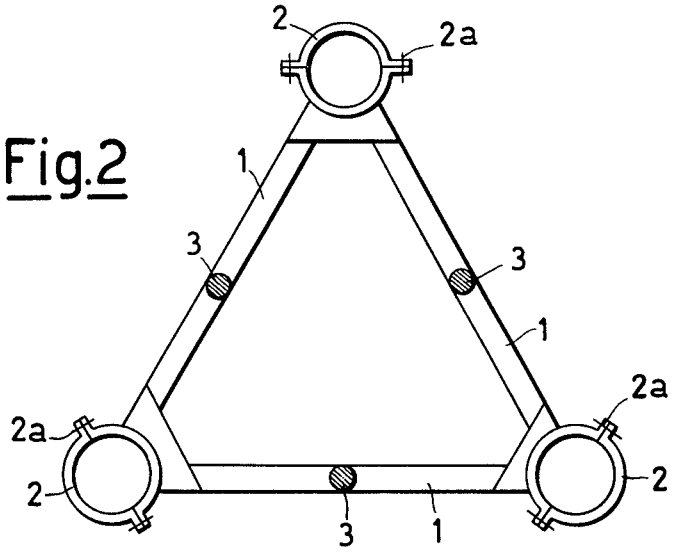
FIG. 2 is a plan view of one of the locking devices shown in FIG. 1.
Figure 3:
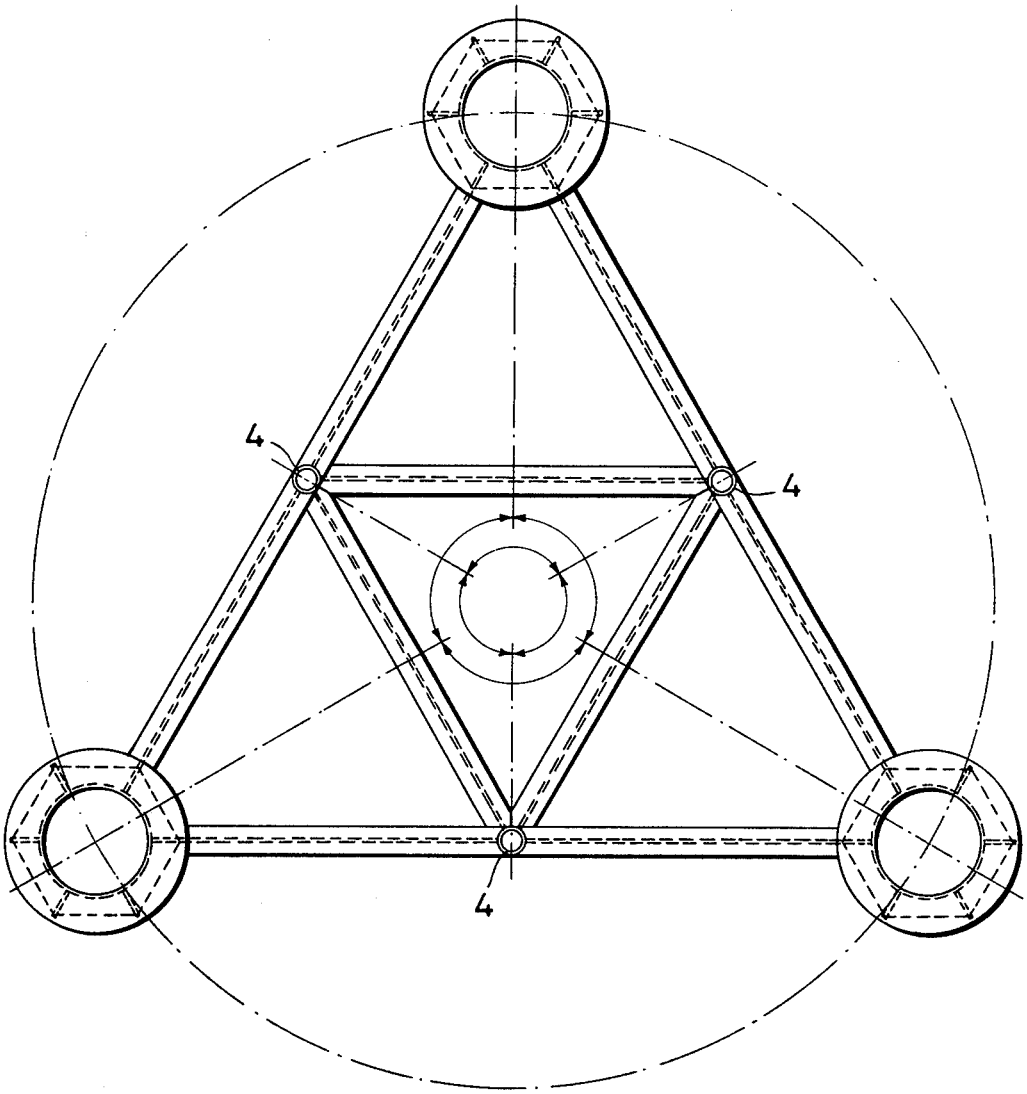
FIG. 3 is a plan view of the base of the buoy support illustrated in FIG. 1.

I claim:

1. In an articulated leg buoy anchoring assembly having polygonal articulate legs universally connected between a buoy and a base on a marine bed to allow movement of the buoy in the sea relative to the base, the improvement which comprises a removable locking device including a polygonal frame having at its ends split sleeves, each one of which clamps one of the articulated legs therebetween, a plurality of vertical struts extending through the sides of said frame to the base, and locators on the base which receive said struts for temporarily rendering the system stationary in the sea for assembly, disassembly, servicing and repair thereof.

2. The removable locking device of claim 1, wherein said struts extend midway through each side of said frame.

3. The removable locking device of claim 2, wherein said frame is formed by stiffening beams having a split sleeve at each end, and wherein said split sleeves are held together by bolts.

4. In an articulated leg buoy anchoring assembly of claim 1, wherein the buoy and the base both have locators which receive said struts of the locking device to temporarily render the assembly stationary.

5. In an articulated leg buoy anchoring assembly of claim 1 having three triangularly spaced articulated legs, a removable locking device having a triangular shaped frame with one of said vertical struts extending midway through each side of said triangular frame.

* * * * *

UNITED STATES PATENT AND TRADEMARK OFFICE

CERTIFICATE OF CORRECTION

PATENT NO. : 4,098,090

DATED : July 4, 1978

INVENTOR(S) : Giuseppe Dotti

It is certified that error appears in the above-identified patent and that said Letters Patent are hereby corrected as shown below:

Column 1, line 28, after "have" delete --been--.

lines 45-50, delete "imarine bed. Such a .....

....devices permitting".

Signed and Sealed this

*Third* Day of *July 1979*

[SEAL]

*Attest:*

*Attesting Officer*

LUTRELLE F. PARKER

*Acting Commissioner of Patents and Trademarks*